US005307955A

United States Patent [19]

Viegas

[11] Patent Number: 5,307,955

[45] Date of Patent: May 3, 1994

[54] FLACCID BOTTOM DELIVERY PACKAGE HAVING A SELF-SEALING CLOSURE FOR DISPENSING LIQUID MATERIALS

[75] Inventor: Fleming Viegas, Mississauga, Canada

[73] Assignee: The Procter & Gamble Company, Cincinnati, Ohio

[21] Appl. No.: 904,222

[22] Filed: Jun. 25, 1992

[51] Int. Cl.[5] ..... B65D 35/08; B65D 35/14; B65D 35/16

[52] U.S. Cl. ..... 222/107; 222/181; 222/185; 222/494

[58] Field of Search ..... 222/494, 181, 185, 107

[56] References Cited

U.S. PATENT DOCUMENTS

| | | | |
|---|---|---|---|
| 3,815,794 | 6/1974 | Carlisle | 222/491 |
| 3,878,977 | 4/1975 | Carlisle | 222/491 |
| 4,163,509 | 8/1979 | Amneus | 222/95 |
| 4,232,721 | 11/1980 | Martin et al. | 222/107 X |
| 4,252,257 | 2/1981 | Herzig | 222/213 |
| 4,484,351 | 11/1984 | Leeuwe et al. | 222/107 X |
| 4,519,530 | 5/1985 | Schmidt | 222/494 |
| 4,728,006 | 3/1988 | Drobish et al. | 222/181 |
| 4,732,299 | 3/1988 | Hoyt | 222/107 X |
| 4,749,108 | 6/1988 | Dornbusch et al. | 222/212 |
| 4,830,205 | 5/1989 | Hammond et al. | 222/107 X |
| 4,948,015 | 8/1990 | Kawajiri et al. | 222/107 |
| 4,969,581 | 11/1990 | Seifert et al. | 222/212 |
| 4,974,732 | 12/1990 | Sullivan et al. | 206/610 |
| 5,018,646 | 5/1991 | Billman et al. | 222/107 |
| 5,115,950 | 5/1992 | Rohr | 222/494 |

FOREIGN PATENT DOCUMENTS 2098958 12/1982 United Kingdom .

OTHER PUBLICATIONS

Sheet A, Sheet B and sheet C: Photographs showing a front and bottom views of known packages of Procter & Gamble, Winton Hill Technical Center, Aug. 15, 1992.

*Primary Examiner*—Sherman Basinger
*Attorney, Agent, or Firm*—Dean L. Garner

[57] ABSTRACT

A flaccid and lightweight bottom delivery package for dispensing fluid products. The package comprises a tubular container for housing the fluid products. The container has a closed top and an open bottom having a gusset panel attached thereto. The gusset panel and that portion of the container below the gusset panel define a stand-up base that allows the package to stand alone on a flat surface while resting on its bottom end. The gusset panel has a discharge orifice disposed therein and a self-sealing valve sealingly secured to the discharge orifice. The valve has a closed position for storage and an open position for dispensing. The valve opens in response to manual squeezing forces being applied to the container, and closes when said manual forces are removed. The package further includes a hook or the like adjacent its top end for hanging the package from a support.

14 Claims, 6 Drawing Sheets

FLACCID BOTTOM DELIVERY PACKAGE HAVING A SELF-SEALING CLOSURE FOR DISPENSING LIQUID MATERIALS

FIELD OF THE INVENTION

The present invention relates to packages for storing and dispensing fluid materials. More particularly, the invention relates to bottom delivery packages for storing and dispensing viscous fluid materials such as shampoos, conditioners, soaps, detergents, and the like, wherein the containers have self-sealing dispensing valves disposed therein. The invention has further relation to such packages that are designed to be stored and used while being hung from a shower head, hook or other support to facilitate easy dispensing.

BACKGROUND OF THE INVENTION

Bottom delivery packages for liquid products have been used for some time. As used herein the term "bottom delivery" package refers to a package having a means to dispense a liquid from its bottom end. Bottom delivery packages are typically flexible and have valves or other closures on their bottoms so as to dispense the liquid by applying manual forces to, i.e. squeezing, the package. Some "bottom delivery" packages rest on their bottom ends where the valve is disposed so that liquid product drains towards the valve when the package is not in use. This eliminates the need to shake the package in order to force the liquid down towards the valve when the package is almost empty. "Bottom delivery" packages may also include hangers or apertures near their tops so as to hang the package from a hook or other type of support. This also drains the fluid towards the valve in the bottom of the package. The liquid can thereby be dispensed by squeezing the package with one hand while it is being supported.

Bottom delivery packages having self-sealing valves for storing and dispensing fluid materials such as shampoos, conditioners, soaps or detergents are generally known in the art. The use of a self-sealing valve eliminates the need to operate a removable closure when dispensing the product. Typically the self-sealing valve has a closed position for preventing any discharge of fluid through the valve when not in use, and an open position to dispense fluid through the valve upon the application of manual squeezing forces. An example of a "bottom delivery" package having a self-sealing valve that rests on its bottom end is disclosed in commonly assigned U.S. Pat. No. 4,969,581 issued to Seifert et al. on Nov. 13, 1990. The package disclosed in Seifert et al. discloses a flexible "bottom delivery" package having a self-sealing valve at its bottom. This package is provided with a base that allows the package to stand in an upright position, with the valve facing downward. Because the package is able to stand upright in this position, labels or other advertising can be placed on the package so that they are read correctly with the package in this position. However, the Seifert package does not include a means adjacent its top end to hang the package from a support. The package must therefore be picked up and placed back down every time it is used. This is inconvenient for the consumer.

An example of a bottom delivery package having a self-sealing valve that can be hung from a hook, shower head or other support is disclosed in commonly assigned U.S. Pat. No. 4,728,006 issued to Drobish et al. on Mar. 1, 1988 the disclosure of which is hereby incorporated herein by reference. Drobish discloses a flexible package having a self-sealing dispensing valve to provide automatic shut-off and leak resistant inverted storage. The package disclosed in Drobish has a recessed notch or a hook integral with the package so as to suspend the package on a shower head in an inverted position.

This type of package is convenient for dispensing shampoos or conditioners while in the shower. Because the package hangs from the shower head with the valve pointing downward, dispensing liquid from the package is easy. The consumer simply places the palm of one hand under the self sealing valve and squeezes the package with the other hand. Once the correct amount of liquid is dispensed in the palm of the hand the consumer stops squeezing the package whereby the self-sealing valve shuts off the flow of liquid. The self-sealing valve eliminates the need for the consumer to operate some type of additional closure such as a screw on cap. Furthermore, the self sealing valve prevents the liquid product in the package from dripping out of the package and down towards the drain. This causes some of the product to be wasted and also creates a mess in the shower.

Recently in order to save natural resources, there has been a desire to reduce the amount of plastic used to make such "bottom delivery" packages. However, when the amount of plastic is significantly reduced, they become flaccid and bag like and have difficulty standing alone in an upright position. If the package is too flexible to support itself it tips over.

It is preferred that the flaccid "bottom delivery" package be able to stand alone in an upright position while resting on its bottom end has many advantages. Because the top and bottom ends on these packages are typically small it is usually desired to have any labels or other advertising adhered to the side of the package. Therefore, for purposes of displaying the package on a store shelf it is better that the package rest on its bottom end, instead of laying flat on its side, so as to clearly show the label. Furthermore, having the label appear in its upright position while the bottom is pointing down allows the consumer to read the label while it is being hung from a shower head or other support.

In addition, the ability of the flaccid package to stand on its own eliminates the need to ship and store the package in an outer carton or the like so it can stand upright. This reduces the volume of space needed to ship the package and reduces the amount of shelf space needed to display it. Also, eliminating the need for such cartons reduces the consumption of natural resources.

Therefore, it is an object of the present invention to provide a lightweight flaccid "bottom delivery" package to reduce the consumption of natural resources, whereby the package is able to stand alone in an upright position.

It is another object of the present invention to provide such a flaccid package that can be effectively displayed on a store shelf or the like without the need to ship and store the package in outer cartons.

It is another object of the present invention to provide such a flaccid "bottom delivery" package for dispensing shampoos, conditioners, liquid detergents or the like while being hung from a shower head, hook or other support.

It is another object of the present invention to provide such a flaccid "bottom delivery" package with a self-sealing valve wherein the valve has a closed position for storage and an open position for dispensing whereby the valve opens in response to manual squeezing forces applied to the package, yet closes when the manual squeezing forces are removed.

The aforementioned and other objects of the invention will become more apparent hereinafter.

SUMMARY OF THE INVENTION

In accordance with the present invention there is provided a flaccid and lightweight bottom delivery package for dispensing fluid products. The package comprises a flacid tubular container for housing the fluid product. The container has a closed top and an open bottom. A gusset panel is sealingly secured to the bottom end of the container and has a discharge orifice disposed therein. The gusset panel is secured to the container so as to define a flexible stand-up base that allows the package to stand alone on a flat surface while resting on its bottom. The stand up base comprises the gusset panel and that portion of the container below the gusset panel. A self-sealing valve is sealingly secured to the discharge orifice on the gusset panel. The self-sealing valve has a closed position for storage of the package so as to substantially prevent unwanted leakage of fluid through the valve when the package is not in use. The self-sealing valve also has an open position whereby the valve opens in response to the manual squeezing forces applied to the container, thereby permitting discharge of the fluid through the discharge orifice. Upon the release of the manual squeezing forces the valve returns to its closed position, thereby substantially terminating the discharge of fluid product. Lastly, the package includes a means, adjacent its top end, to hang the package from a support.

In one embodiment of the present invention the discharge orifice is disposed in the center of the gusset panel and the gusset panel has a concave configuration extending towards the bottom of the package. The gusset panel then acts as a funnel directing the liquid product towards the discharge orifice.

In another embodiment the means to hang the package from a support comprises an aperture extending through the top end of the package. The container is sealed together about the aperture to prevent leakage of liquid product.

In yet another embodiment the tubular container comprises two panels of flexible material sealed along their top and side peripheral edges.

BRIEF DESCRIPTION OF THE DRAWINGS

While the specification concludes with claims particularly pointing out and distinctly claiming the subject invention, it is believed that the same will be better understood from the following description when taken in conjunction with the accompanying drawings in which:

DETAILED DESCRIPTION OF THE INVENTION

Figure 1:
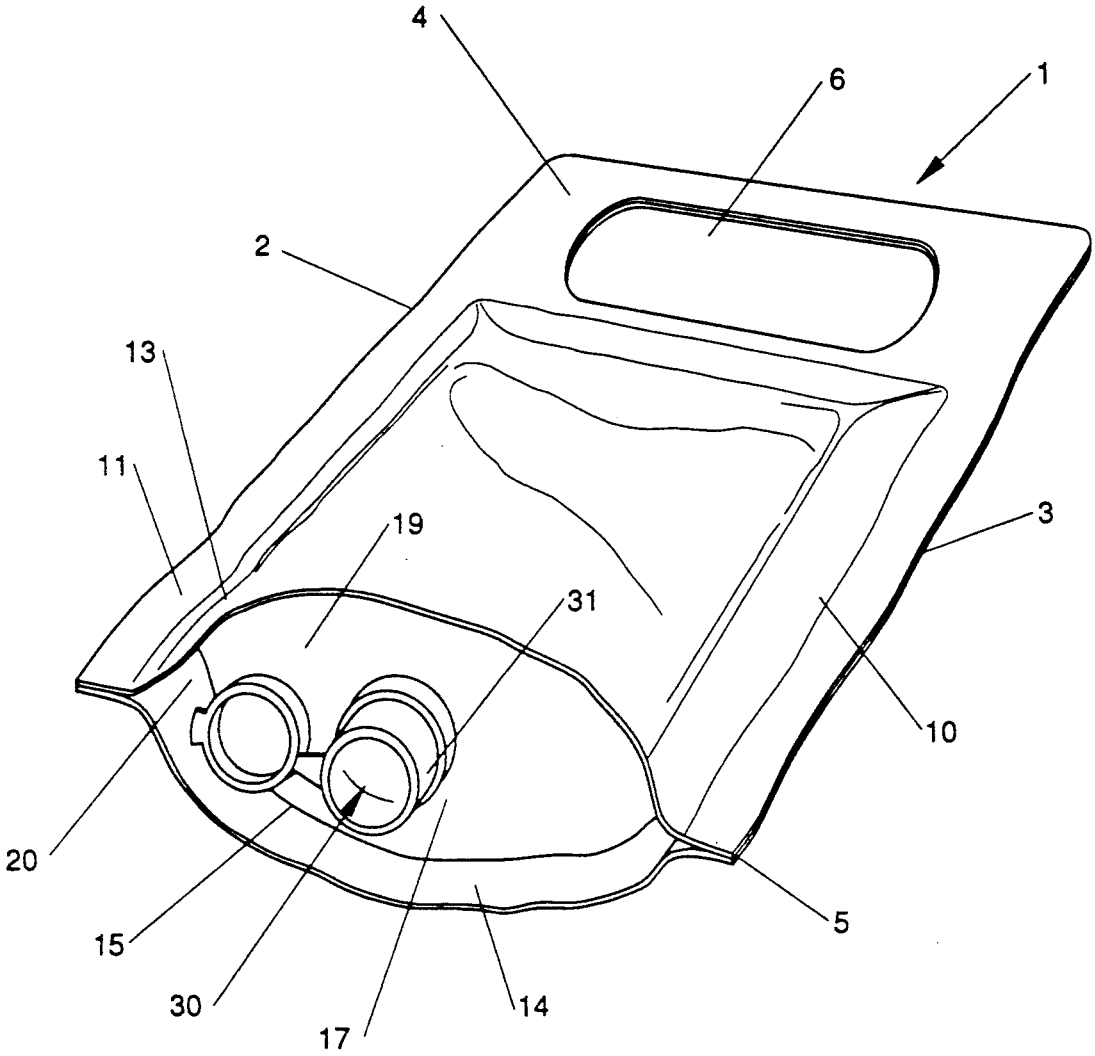
FIG. 1 is a perspective view of the package of the present invention.

Referring to the drawings in detail wherein like numerals indicate the same element throughout the views there is shown in FIG. 1 a bottom delivery package I for dispensing fluid products such as shampoos or the like. Package I includes a tubular container 10 for housing the fluid material. Container 10 can be constructed of one piece of material or, as is shown in the Figures, can be made from two panels of flexible material. As shown in FIG. 1 container 10 comprises a front panel 11 having inner surface 12 (not shown) and outer surface 13, and a back panel 14 having inner surface 15 and outer surface 16 (not shown). Front panel 10 and back panel 14 are sealed together along the peripheral edges of the top 4 and sides 2 and 3 of package 1.

Figure 2:
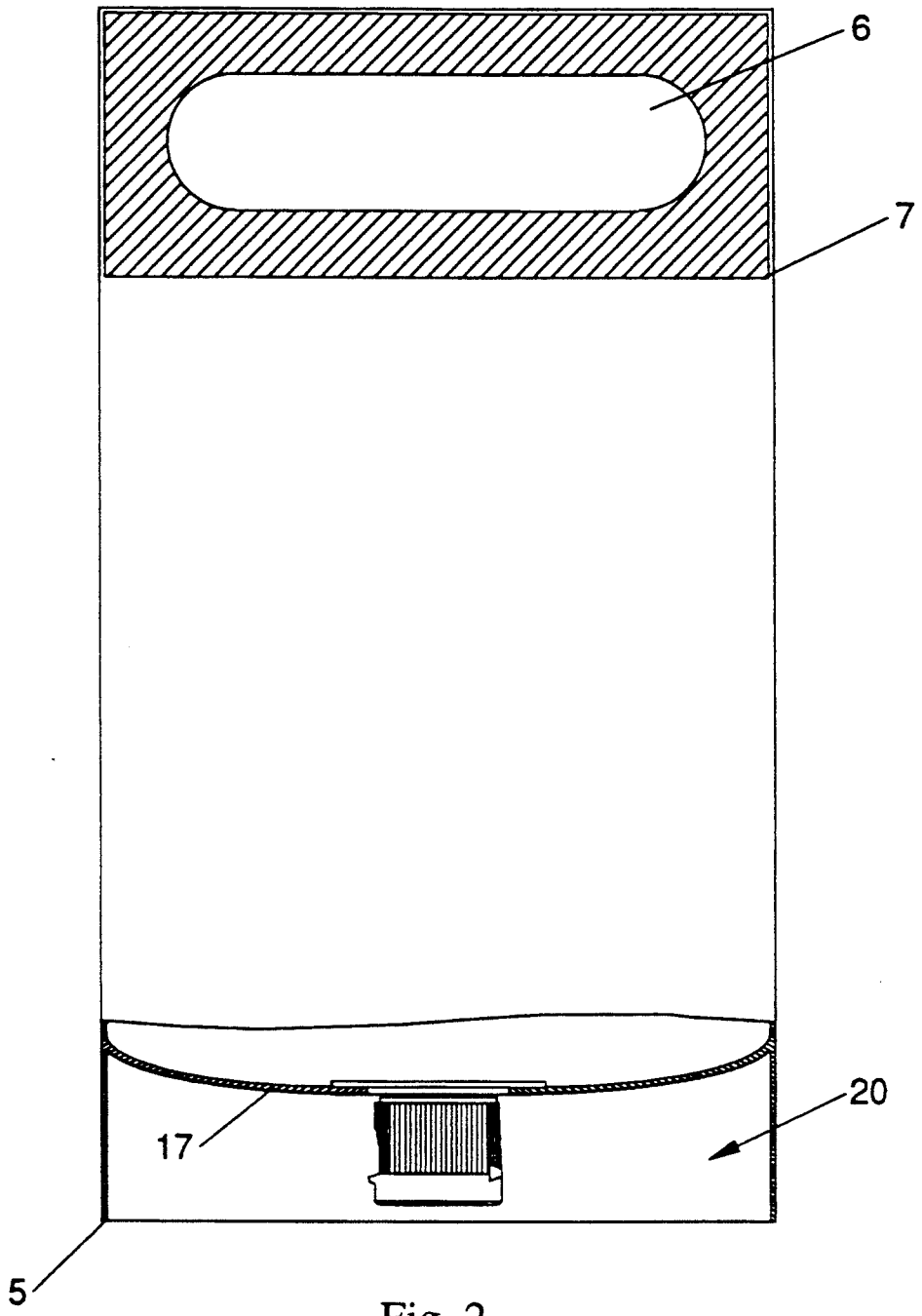
FIG. 2 is a sectional view of the package of the present invention.

Package I also includes gusset panel 17 having inner surface 18 (not shown) and outer surface 19.. Gusset panel 17 is sealed to front panel 11 and back panel 14 at a point adjacent the bottom 5 of package 1. Gusset panel 17 includes a discharge orifice 30 disposed therein for dispensing of the fluid product (shown in FIG. 3) and valve assembly 31 sealingly secured to the gusset panel 17. In a preferred embodiment gusset panel 17 is sealed to the container in a concave fashion as shown in FIG. 2. This allows the liquid product to drain towards the discharge orifice.

In a preferred embodiment front panel 11, back panel 14 and gusset panel 17 are each made from three layers of flexible laminate material. The inner surfaces 12, 15, and 18, of panels 11, 14 and 17 respectively are preferably made from a layer of polyethylene. The outer surfaces 13, 16 and 19 of panels 11, 14 and 17 respectively are preferably made from a layer of polyester. In addition, it is preferred that panels 11, 14 and 17 comprise a middle layer of polyethylene terephthalate (PET) sandwiched between the inner layer of polyethylene and the outer layer of polyester. Such an embodiment produces a non-resilient flexible bottom delivery package.

The outer layer of polyester allows for printing to easily be placed directly on the package because it does not stretch during the printing process. This unwanted stretching could deform the shape of the package and make its appearance less desirable. As for making the inner surfaces from polyethylene, good sealing is obtained when the panels are joined together to form container 10. How the panels are sealed together is discussed below, however, good sealing prevents unwanted leakage of product around the areas where the front 11, back 14 and gusset 17 panels are joined together. Finally, to prevent oxygen from penetrating the package and mixing with the fluid product, where it could cause degradation, a layer of PET is sandwiched between the inner and outer surfaces of the package. Polyethylene terephthalate provides a good barrier between the fluid and elements of the environment such as oxygen. In an alternative embodiment a fourth layer of aluminum could be sandwiched between the PET layer and the inner layer of polyethylene to provide even more of a barrier.

It has been found preferable to join the outer layer of polyester to the middle layer of PET by gluing. Various types of suitable glues known in the art can be used. It has been shown that it is preferred to join the inner layer of polyethylene and the middle layer of pet by heat sealing the two layers together.

As stated earlier front panel 10 and back panel 14 are sealed together along the peripheral edges of the top 4 and sides 2 and 3 of package 1, and the gusset panel 17 is sealed to front panel 11 and back panel 14 at a point adjacent the bottom 5 of package 1. The panels are preferably joined together by heat sealing. In a preferred embodiment the inner surface 12 of front panel 11 is heat sealed to the inner surface 15 of back panel 14 along the peripheral edges of sides 2 and 3, and top 4 of package 1. Also, the inner surface 12 of front panel 11 and inner surface 15 of back panel 14 are heat sealed to the outer surface 15 of gusset panel 17.

Gusset panel 17 and those portions of front panel 11 and back panel 14 adjacent to the gusset panel 17 define stand up base 20. Stand-up base 20 takes the form of a tapered annular ring. Stand up base 20 allows package I to stand alone in an upright position while resting on its bottom 5, as shown in FIG. 2. The surface area of gusset panel 17 gives the package stability. The smaller the surface area of gusset panel 17, the more likely the package will have a tendency to tip over. Conversely, the larger the surface area of gusset panel 17, the less likely the package will have a tendency to tip over. Furthermore, due to the design of the package, most of the product is near the bottom and hence most of the weight is also. This also gives the package greater stability to stand on its bottom end without tipping over. It is preferred that the cross section of the package be larger at its bottom than at its top.

Package 1 further includes a means adjacent its top end 4 for hanging the package from a shower head or other support. FIGS. 1 and 2 show package 1 having an aperture 6 adjacent top end 4, that enables the package to be hung from a shower head. Aperture 6 can be made by cutting out portions of the front and back panels 11 and 14 corresponding to the aperture 7. Thereafter front panel 11 would be sealed to back panel 14 about aperture 6 to prevent leakage of product through the aperture 6. Or in a similar fashion aperture 7 can be formed by sealing inner surface 12 of front panel 11 to inner surface 15 of back panel 14 from the top 4 down to a point 7 adjacent top 4. Thereafter aperture 6 is cut out from the two sealed layers.

Figure 5:
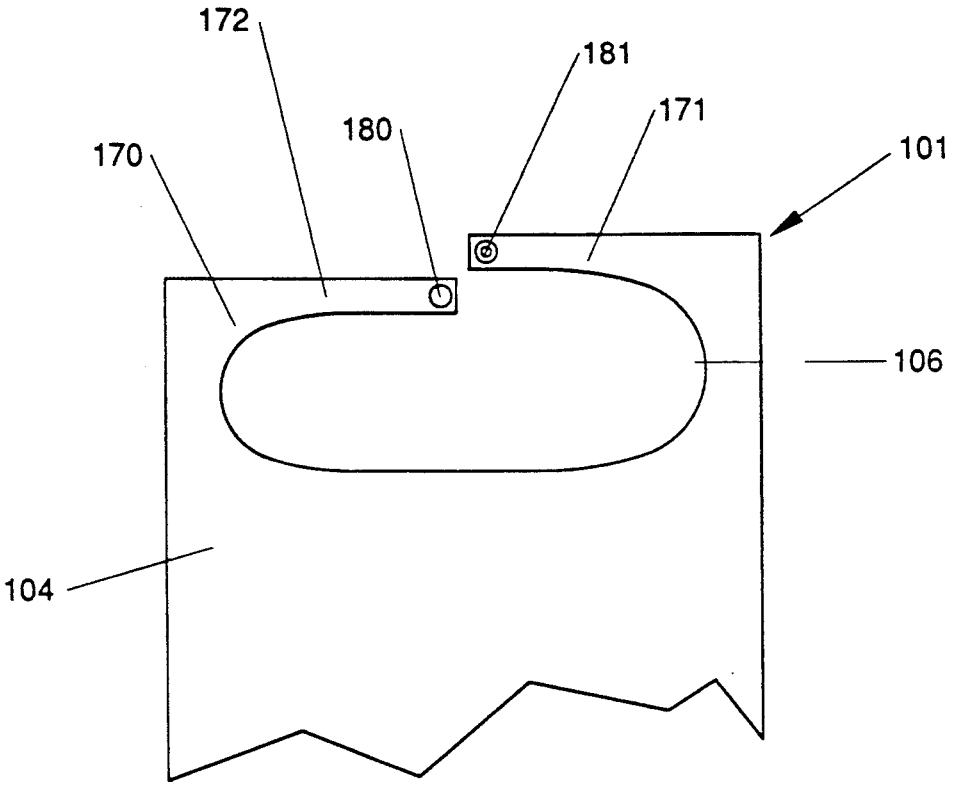
FIG. 5 is a partial elevational view of an alternative embodiment of the top of the package of the present invention.
Figure 6:
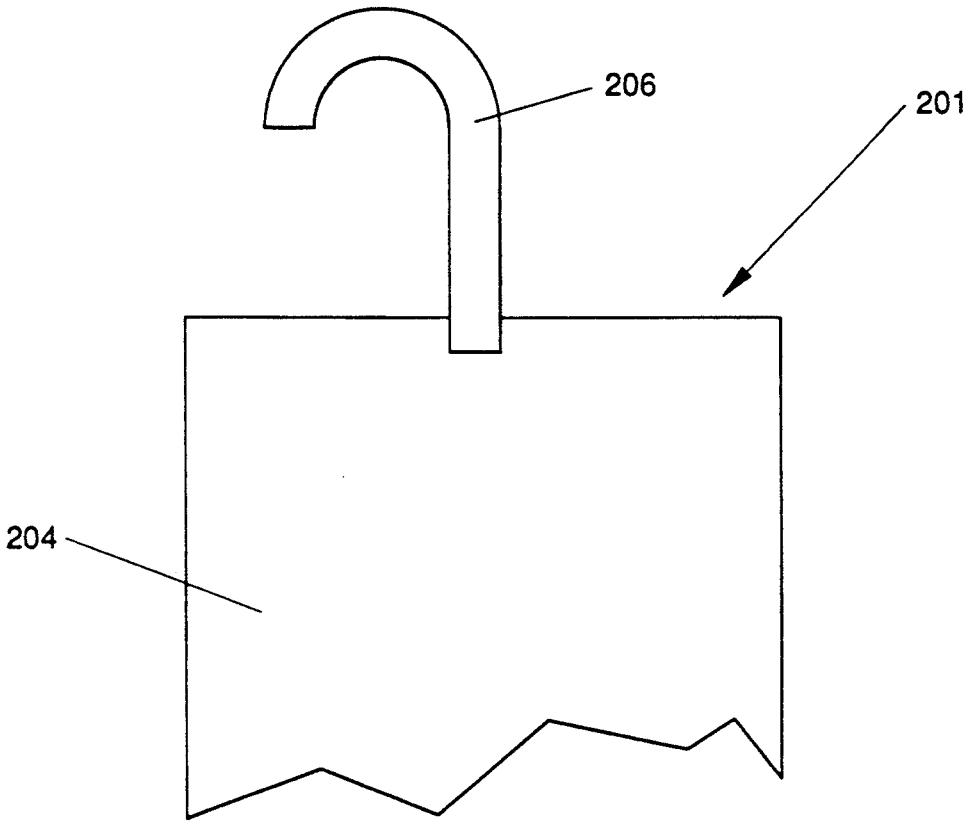
FIG. 6 is a partial elevational view of an alternative embodiment of the top of the package of the present invention.

Other suitable means for hanging the package from a support may al so be used. One alternative embodiment for hanging the package from a support is shown in FIG. 5. FIG. 5 is a partial elevational view of of the top 104 of package 101. Package 101 has aperture 106 adjacent top 104. Package 101 is sealed about aperture 106 to prevent unwanted leakage of product therethrough. The top 170 of aperture 106 is cut as shown to form legs 171 and 172. Leg 172 has snap half 180 attached to it and leg 171 has snap half 181 attached to it. The package is connected to a support such as a shower head by placing the support through the aperture 106 and snapping legs 171 and 172 together. Another alternative embodiment is shown in FIG. 7. FIG. 7 is a partial elevational view of the top 204 of package 201. Package 201 has hook 206 made from polyethylene or other suitable material that is sealed on to the top of the package.

Many types of valve assemblies and self-sealing valves known in the art may be suitable to dispense fluid product from the package of the present invention. However, the self-sealing valve that is to be used must have the proper opening and closing characteristics. The valve needs to be able to overcome the hydraulic head of the full package and remain closed when not in use. Furthermore, the valve needs to be able to open and dispense the product in response to manual squeezing forces applied to the package. Finally, the valve needs to be able to return to its closed position when the manual squeezing forces are removed so as to substantially stop the flow of product through the valve.

Figure 3:
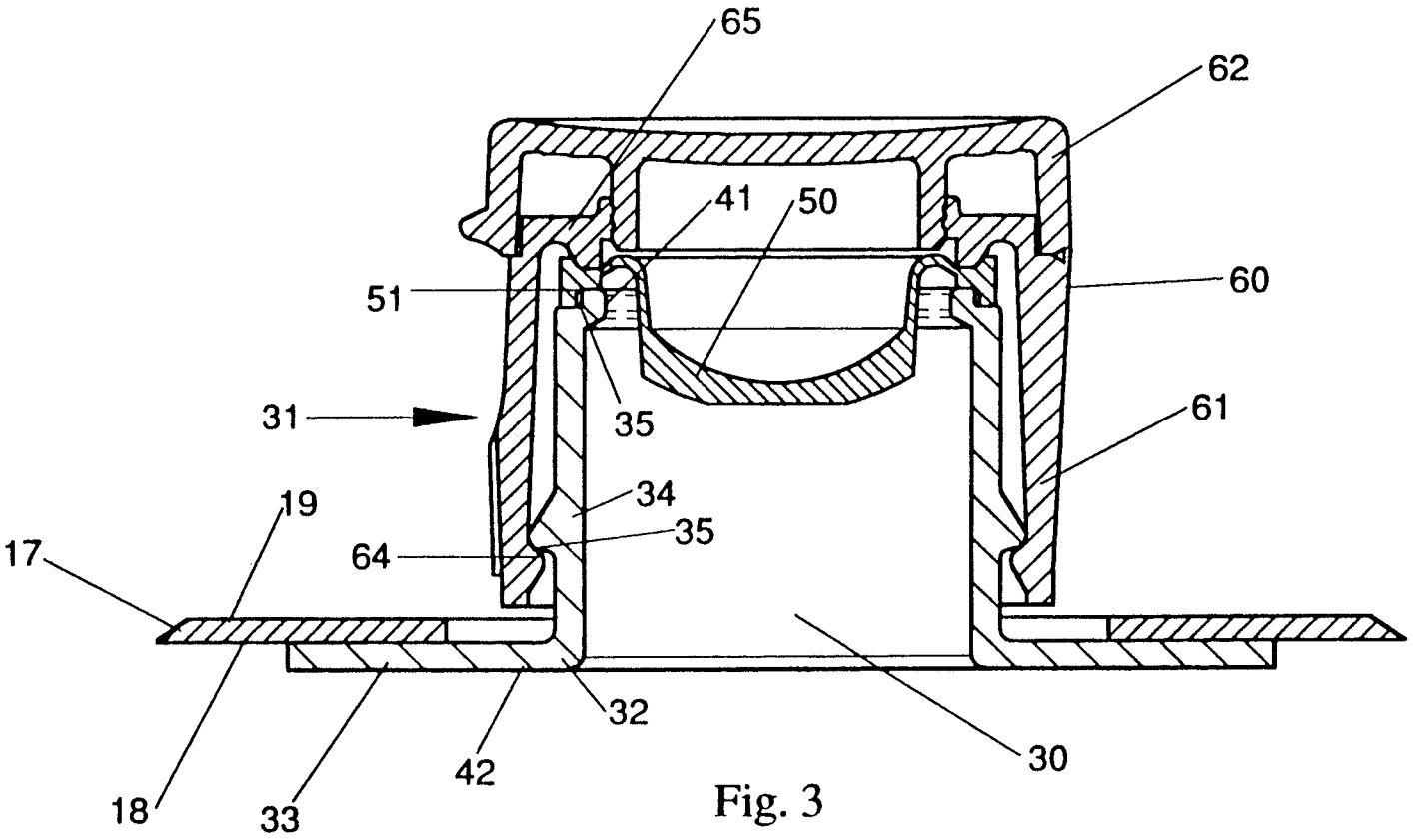
FIG. 3 is a partial sectional view of the preferred valve assembly 31 of the package of the present invention.

The preferred embodiment for valve assembly 31 is shown in FIG. 3. Valve assembly 31 -includes gland 32 which comprises tubular neck 34 having two open ends 41 and 42. End 41 is adjacent valve 50 and end 33 is attached to or integrally molded with an outwardly extending annular flange 33. Annular flange 33 is sealingly secured to the inner surface 18 of gusset panel 17. The gland is preferably made from polyethylene or polypropylene and is secured to the bag by applying pressure and heat so as to thermally bond annular flange 33 to gusset panel 17.

Valve assembly 31 further includes self-sealing valve 50 which is preferably made from silicone. Self sealing valve 50 has stepped section 51 that rests on step section 35 of neck 34. In order to secure the valve 50 to neck 34 valve assembly 31 is provided with flip cap 60. Flip cap 60 includes base 61 and closure 62. Closure 62 is attached to base 61 by means of a hinge 63. Base 62 has an annular flange 64 which snaps fits over annular flange 35 on neck 34. The valve 50 is then sandwiched between the top 65 of base 61 and neck 34 securing it to valve assembly 31. Other ways of attaching the base 61 to the neck 34 could be used. One way would be to place threads on the neck and base so that the base screws onto the neck. Furthermore other ways of attaching valve 50 to neck 34 could also be used.

The self-sealing valve 50 comprises concave face 57, having one or more slits 58 disposed therein, and annular side wall 55. Self-sealing valve 50 is preferable of one piece construction made from silicone. Valve 50 has a closed position for when the package is being stored so as to prevent unwanted leakage of fluid product through discharge orifice 30 when package I is not in use. Self-sealing valve 50 also has an open position to dispense the fluid product. The valve is designed to open in response to manual squeezing forces being applied to the package along the front and back panels 11 and 14. Upon removal of the manual squeezing forces the valve closes thereby substantially terminating the discharge of the fluid through the discharge orifice 30.

Figure 4B:
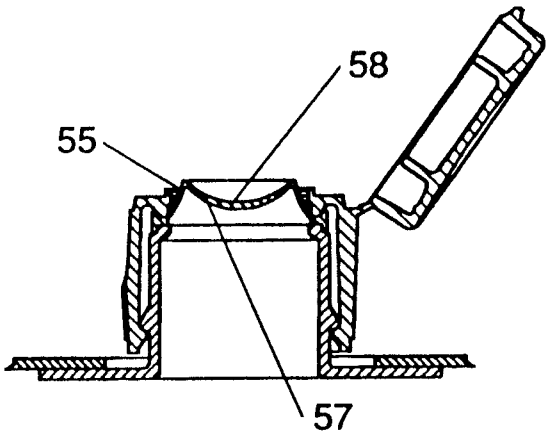
FIG. 4B is a view similar to FIGS. 3 and 4A but with self-sealing valve 50 in the open position.
Figure 4A:
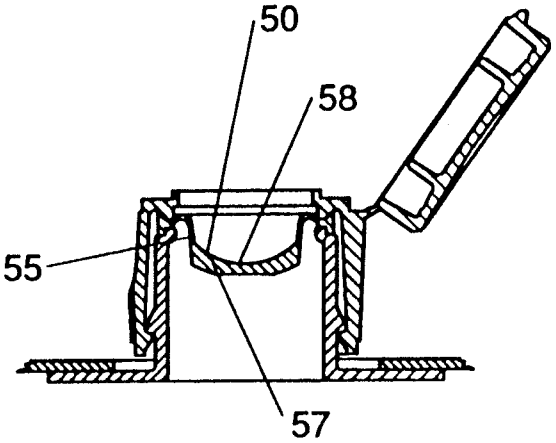
FIG. 4A is view similar to FIG. 3.

The operation of self-sealing valve 50 can best be understood by referring to FIGS. 4A and 4B. FIG. 4A is a cross sectional view of valve assembly 31 wherein valve 50 is in its closed position. FIG. 4B is a similar drawing wherein valve 50 is in its open position. The valve's normal position is the closed position shown in FIG. 4A. When manual squeezing forces are applied to the container 10 liquid product pushes onto valve 50, the pressure exerted by the liquid product causes annular side wall 55 of valve 50 to push outwardly. This also causes slits 58 to open and product to escape therethrough. When the manual squeezing forces are removed the pressure from the liquid product on valve 50 is removed. The resiliency of silicone valve 50 causes annular side wall 55 to return to its original position thereby sealing the valve.

Flip cap 60 of valve assembly 31, shown in FIG. 3, has advantages than securing the valve 50 to neck 34. Flip cap 60 allows the package to be transported without accidental leakage of liquid product through dispensing orifice 30. During transport of the package I pressure could easily be applied to the container 10 unintentionally. If this happens product will dispense from the orifice 30. However, the flip cap will substantially prevent this from occurring. Other types of removable caps could be used to accomplish these objectives. For example a screw on cap instead of a flip cap could be used. Furthermore, a tear tab safety seal, of the type often found on the closures of milk or juice bottles could be used to prevent unwanted discharge of fluid prior to delivery of the package to the consumer. For example a rupturable piece of plastic or other material can be placed on the container joining closure 62 to base 61 of flip cap 60. When first opening the package this seal would be broken so the flip cap can be opened.

While particular embodiments of the present invention have been illustrated and described, various modifications will be apparent to those skilled in the art without departing from the spirit and scope of the present invention. Accordingly, the scope of the present invention should be considered in terms of the following claims and is understood not to be limited to the details described and shown in the specification and drawings.

What is claimed is:

1. A flaccid and lightweight bottom delivery package for storing and dispensing fluid products, said package comprising:

(a) a flaccid tubular container for housing said fluid product, said container having a closed top and an open bottom;

(b) a gusset panel sealingly secured to said bottom of said container and having a discharge orifice disposed therein, said gusset panel being secured to said container so as to define a flexible stand up base comprising said gusset panel and a portion of said tubular container below said gusset panel, said base allowing said package to stand alone on a flat surface;

(c) a self-sealing valve sealingly secured to said discharge orifice, said valve having a closed position so as to substantially prevent unwanted leakage of fluid when said package is not in use, said valve also having an open position for dispensing said fluid through said discharge orifice in response to manual squeezing forces being applied to said container, said valve being able to return to its closed position upon removal of said manual squeezing forces so as to substantially stop the dispensing of said product through said discharge orifice; and (d) a means, adjacent the top end of said package, for hanging said package from a support.

2. The package of claim I wherein said discharge orifice is disposed in the center of said gusset panel and said gusset panel has a concave configuration so as to act as a funnel directing all of the fluid product down towards said discharge orifice.

3. The package of claims 1 or 2 wherein said means for hanging said package from a support is an aperture extending through said top end of said package, said container being sealed about said aperture to prevent unwanted leakage of liquid product through said container.

4. The package of claim 1 wherein said means for hanging said package from a support comprises a hook secured to the top of said package.

5. The package of claim 1 wherein said means to hanging said package from a support comprises an aperture extending through said top end of said package, said container being sealed about said aperture to prevent leakage of said liquid product, said aperture being open at said top of said package so as to define two legs adjacent said top of said package, said legs having a means for attaching themselves together so as to close said aperture about said support.

6. The package of claim 1 or 2 wherein said tubular container comprises two substantially flat panels sealed along their top and side peripheral edges.

7. The package of claim 6 wherein said tubular container and said gusset panel comprise inner, outer and middle layers of flexible laminate material attached to each other in face-to-face relation, said outer layer comprising polyester, said middle layer comprising polyethylene terephthalate, and said inner layer comprising polyethylene.

8. The package of claim 7 wherein said outer and middle layers are joined by gluing, and said inner and middle layers are joined by heat sealing.

9. The package of claim 1 wherein said self-sealing valve is attached to said gusset panel by means of a gland said gland comprising an enclosed tubular neck having two open ends, said self-sealing valve being disposed at one end and an outwardly extending annular flange being disposed at the other end, said annular flange being sealed to the interior surface of said gusset panel about said discharge orifice.

10. The package of claim 9 wherein said self-sealing valve comprises a upwardly concave face having at least one slit disposed therein, said face being connected to said gland by means of a resilient annular wall, such that when said manual squeezing forces are applied to said container said concave face and said annular wall move outwardly causing said fluid product to dispense through said slit, whereby when said manual squeezing forces are removed said concave face and said annular wall return to their original position thereby ceasing said dispensing through said slit.

11. The package of claim 10 wherein said concave face and said annular wall are of one piece construction made from silicone.

12. The package of claim 1 further including a removable cap covering said valve so as to prevent unwanted discharge of fluid product through said valve when transporting said package.

13. The package of claim 12 wherein said cap is a flip cap hingedly attached to said package, said flip cap being able to snap fit over said valve.

14. A flaccid and lightweight bottom delivery package for storing and dispensing fluid products, said package comprising:

(a) a tubular container for housing said fluid product, said container comprising a front panel and a back panel of flexible material, said panels being sealed along their top and side peripheral edges, said container having a closed top and an open bottom;

(b) a gusset panel sealingly secured to said bottom of said container and having a discharge orifice disposed therein, said discharge is disposed in the center of said gusset panel and said gusset panel having a concave configuration so as to direct all of the fluid product down towards said discharge orifice, said gusset panel being secured to said container so as to define a stand up base comprising said gusset panel and a portion of said tubular container below said gusset panel, said base allowing said package to stand alone on a flat surface;

(c) a self-sealing valve sealingly secured to said discharge orifice, said valve having a closed position so as to substantially prevent unwanted leakage of fluid when said package is not in use, said valve also having an open position for dispensing said fluid through said discharge orifice in response to manual squeezing forces being applied to said container, said valve being able to return to its closed position upon removal of said manual squeezing forces so as to substantially stop the dispensing of said product through said discharge orifice, said self-sealing valve being attached to said gusset panel by means of a gland, said gland comprising an enclosed tubular neck having two open ends, said self-sealing valve being disposed at one end and an outwardly extending annular flange being disposed at the other end, said annular flange being sealed to the interior surface of said gusset panel about said discharge orifice;

(d) said self-sealing valve comprising a upwardly concave face having at least one slit disposed therein, said face being connected to said gland by means of a resilient annular wall, such that when said manual squeezing forces are applied to said container said concave face and said annular wall move outwardly causing said fluid product to dispense through said slit, whereby when said manual squeezing forces are removed said concave face and said annular wall return to their original position thereby ceasing said dispensing through said slit;

(e) a removable cap covering said valve so as to present unwanted discharge of fluid product through said valve when transporting said package; and (f) a means, adjacent the top end of said package, for hanging said package from a support, said means comprising an aperture extending through said top end of said package, said container being sealed about said aperture to prevent leakage of said liquid product through said container.

* * * * *